United States Patent [19]

Perkins

[11] 4,424,924

[45] Jan. 10, 1984

[54] HOLSTER WITH MOUNTING SPRING

[75] Inventor: Neale A. Perkins, Bradbury, Calif.

[73] Assignee: Safariland Ltd., Inc., Monrovia, Calif.

[21] Appl. No.: 286,691

[22] Filed: Jul. 24, 1981

[51] Int. Cl.[3] ..... F41B 13/04

[52] U.S. Cl. ..... 224/252; 224/269; 224/911; 224/192

[58] Field of Search ..... 224/269, 252, 192, 194, 224/911, 912, 914

[56] References Cited

U.S. PATENT DOCUMENTS

| | | | |
|---|---|---|---|
| 984,367 | 2/1911 | Fountain | 224/252 |
| 1,045,713 | 11/1912 | Lewis | 224/252 |
| 3,250,448 | 5/1966 | Clark | 224/252 |
| 3,902,639 | 9/1975 | Rogers | 224/194 X |

*Primary Examiner*—Steven M. Pollard

*Attorney, Agent, or Firm*—Christie, Parker & Hale

[57] ABSTRACT

One embodiment of this invention provides a holster for holding a hand gun. The holster includes a generally U-shaped mounting spring under stiff tension against the exterior inside face of the holster. The mounting spring has a U-shaped fastening portion that fits into a pocket on the inside face of the holster. A fastener extends through the side wall of the holster to secure the fastening portion of the spring to the holster. The holster can be worn without threading a belt through a belt loop on the holster. Instead, the mounting spring firmly but releasably clips the holster to the waistband of the user's trousers, or over the user's belt. The spring can be pulled away from the side of the holster against the bias of the spring to provide a gap for slipping the holster over the waistband or the belt, after which the spring is released, allowing the bias of the spring to clamp the holster firmly in place. The mounting spring has opposite legs extending alongside ridges formed on the inside face of the holster by a contour that matches the shape of the firearm. The legs of the spring therefore tightly clamp onto the user's clothing immediately next to and in line with the contour of the firearm, which tightly holds the holster in a fixed position. The invention also can be used on other similar carrying cases, such as a knife sheath, or any other device which can be clipped to not only a belt or waistband, but other articles, such as a boot or purse, for example.

12 Claims, 7 Drawing Figures

HOLSTER WITH MOUNTING SPRING

FIELD OF THE INVENTION

This invention relates to holsters or similar items that may be carried on a belt or worn on a waistband, for example. More particularly, the invention relates to a novel mounting spring for allowing a holster or the like to be quickly mounted on the waistband of a user's clothing, or over the user's belt, for example, without the need for attaching the holster to a belt by first threading the belt through a belt loop on the holster.

BACKGROUND

The invention can be appreciated by considering its use with holsters, which are but one example of many uses of the present invention. Holsters worn by off-duty and plain-clothes law enforcement officers, for example, are commonly worn relatively high around the officer's waist, usually on his hip, and extremely close to the body to conceal the firearm. Such holsters are ordinarily attached to the officer's belt. In some instances, the holster has a loop through which the belt is threaded, and in other instances the holster is an integral part of the belt. It is often inconvenient and time consuming for the officer to put on his holster by first putting on a belt, especially if the belt must be threaded through belt loops on his trousers. It is also inconvenient and time consuming to remove his belt each time he wants to remove his firearm. Moreover, the conventional belt/holster combination, whether or not the holster is an integral part of the belt, requires the officer to loosen his belt and move it to a different position if he wants to switch his firearm between the conventional mode and a cross-draw mode.

During use of the conventional belt/holster combination, the holster sometimes has a substantial amount of movement relative to the belt, which can be a nuisance, and even a danger, if the officer has to draw his firearm at a moment's notice. Furthermore, it is often difficult to completely conceal a firearm carried in a holster attached to a belt.

My U.S. Pat. No. 3,915,361 discloses a holster with an adjustable mounting clip that can be quickly and easily clipped onto the waistband of a user's clothing without the need for a belt. The mounting clip is in the form of an elongated metal paddle with a non-slip coating on it. The paddle-shaped clip is spaced outwardly from the inside face of the holster. The paddle is intended to provide a stiff means of support against the user's hip. The top of the paddle has a neck that forms a mounting bracket fastened to the side of the holster by a bolt and ratchet combination. This provides means for securely holding the holster in any of a variety of positions relative to the mounting clip.

The present invention, in one embodiment, provides a holster with a mounting spring that is better than any known holster in being mounted quickly to the user's clothing and held tightly in place. In addition, the holster overcomes shortcomings of the holster with the paddle type mounting clip described above. The mounting spring allows the holster to be worn much closer to the body of the user, and the holster also can be more firmly held in a fixed position without rotating relative to the user's body, and without requiring adjustable fasteners or the like. The holster also is simpler in construction and therefore much less expensive to manufacture.

SUMMARY OF THE INVENTION

Briefly, one embodiment of this invention provides a holster having opposed inner and outer faces, and a mounting spring secured to the inner face of the holster. The spring is normally under tension against the inner face of the holster. The spring can be pulled away from the holster against the bias of the spring to widen the gap between the spring and the inner face of the holster. The holster then can be placed over a waistband, belt or the like, on the user's clothing, after which the spring can be released, so the normal tension of the spring toward the inner face of the holster tightly holds the holster in a fixed position.

The holster can be similarly attached to other items of clothing such as a boot, or purse, for example. Further, the mounting spring can be used in a similar manner for items other than holsters, such as knife sheaths, for example.

In one embodiment, the mounting spring is a metal wire rod having a general U-shaped exterior portion in tension against the exterior face of the holster. The inner face of the holster is contoured to match the shape of the firearm carried in the holster. Legs of the U-shaped spring extend alongside ridges formed by opposite edges of the contoured portion of the holster. When a firearm is carried in the holster, the spring tension forces the opposite legs of the spring to press in along the ridges of the contour, and therefore along opposite sides of the firearm, to tightly hold the holster in place on the user's clothing.

Preferably, the mounting spring is secured to the holster by inserting a fastening portion of the spring into a pocket on the inside face of the holster. The fastening portion of the spring is held in place by a fastener extending through it to restrain any movement of the spring. Stitching is provided around the pocket to also hold the mounting spring securely in place in the pocket and to prevent undue wear around the pocket area.

The holster can be quickly and easily mounted on the waistband of a user's clothing or over a user's belt. As an additional advantage, the holster can be quickly moved between a conventional position and a cross-draw position, or adjusted to various angles, if desired. When worn, the holster stays extremely close to the body of the user in a fixed position relative to the user's body.

These and other aspects of the invention will be more fully understood by referring to the following detailed description and the accompanying drawings.

DRAWINGS

DETAILED DESCRIPTION

Figure 1:
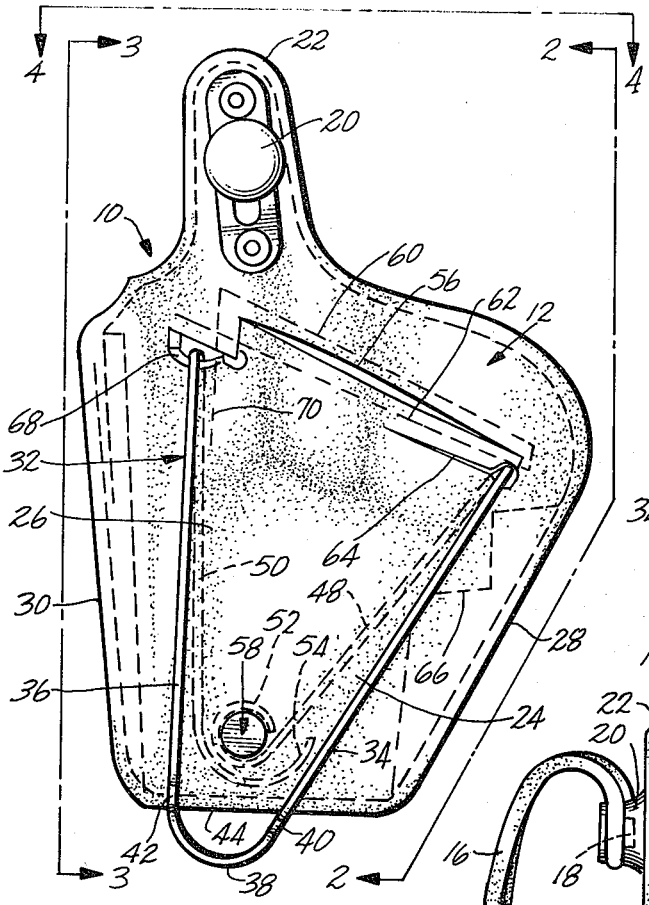
FIG. 1 is a side elevation view showing the inside face of a holster according to principles of this invention.
Figure 2:
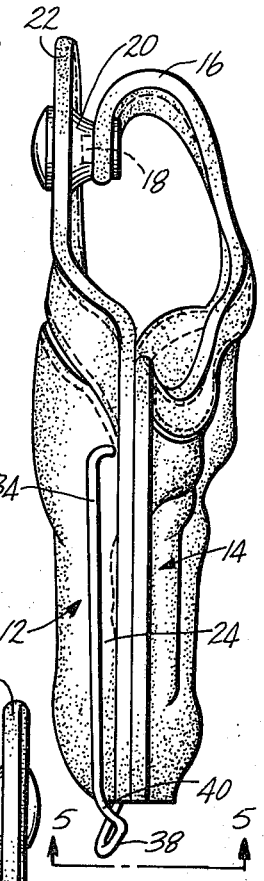
FIG. 2 is an end elevation view taken on line 2—2 of FIG. 1.
Figure 3:
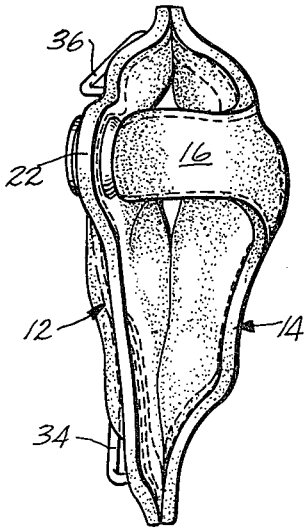
FIG. 3 is an end elevation view taken on line 3—3 of FIG. 1.

The present invention will be described below in the context of its use with a holster, although other uses are possible without departing from the scope of the invention.

Referring to FIGS. 1 through 5, a holster 10 includes a carrying case or receptacle having opposed inner and outer faces 12 and 14, respectively, stitched together to provide the hollow interior of an open-top receptacle for holding a firearm (not shown). A retaining strap 16 integral with the outer face of the holster loops tightly over the hammer of the firearm. A snap ring fastener 18 on the strap fastens to a cooperating snap ring fastener 20 on an upright portion 22 of the inner face of the holster.

The holster is contoured to fit the shape of a specific firearm for which the holster is adapted. The contoured regions of the inside and outside faces of the holster project outwardly to match the shape of the firearm. In the illustrated embodiment, the contoured portion of the inside face of the holster has opposed right and left ridges at 24 and 26 that converge toward one another as they extend toward the bottom of the holster. The ridges formed along opposite edges of the contour are generally straight, extend most of the length of the holster, and are somewhat parallel to the adjacent converging right and left side edges 28, 30 of the holster, respectively.

A generally U-shaped spring 32 is secured to the inside face of the holster. The spring, when mounted to the holster, is normally under stiff tension, bearing against the exterior surface of the inside face of the holster. The spring is of relatively stiff wire rod and has right and left legs 34 and 36 extending along the inside face of the holster generally parallel to the corresponding right and left edges of the holster. A bottom 38 of the U formed by the spring is spaced just below the bottom edge of the holster. The right and left legs of the spring are generally straight and are positioned so they extend alongside the right and left ridges 24 and 26 of the contoured inside face of the holster. Thus, the legs of the spring also extend along the outside edges of the contour of a firearm carried in the holster. The springs bear against the inside face of the holster immediately outside the bulging portion of the holster that matches the contour of the firearm, and this alignment of the spring with the ridges adjacent the contour holds the holster firmly in place during use. This is a particularly important example of why the invention is especially useful with holsters that are contoured to the shape of a firearm.

The bottom 38 of the U is bent inwardly toward the inside face of the holster. The bottom portions of the right and left legs are bent inwardly at 40 and 42 so that these portions of the spring bear against and pass over the bottom edge of the holster, with the U being spaced below the bottom edge of the holster and being positioned generally over the opening 44 at the bottom of the holster. This facilitates gripping the bottom of the U and pulling the spring away from the inside face of the holster, as illustrated in phantom lines at 46 in FIG. 4.

Figure 6:
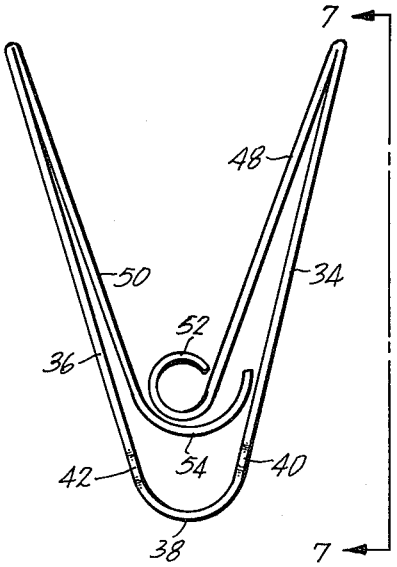
FIG. 6 is a front elevation view showing a mounting spring removed from the holster and in its normal unbiased position.
Figure 7:
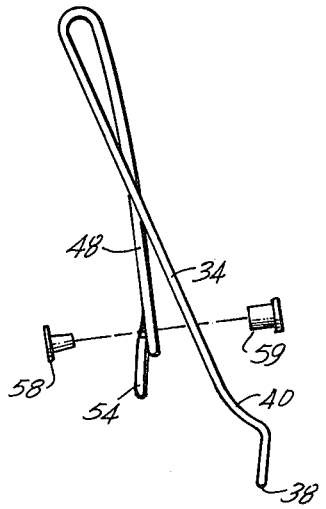
FIG. 7 is a side elevation view taken on line 7—7 of FIG. 6.

Construction of the mounting spring is best illustrated in FIGS. 6 and 7. The spring is a one piece wire rod having a U-shaped fastening portion formed by right and left legs 48, 50 that converge toward each other in the same general direction of convergence of the right and left legs 34, 36 that form the exterior portion of the spring during use. The bottom of the right leg is rounded to form a small loop 52 spaced upwardly from the bottom 38 of the U formed by the exterior portion of the spring. The bottom of the left leg 50 is curved at 54 to generally match the contour of the looped bottom portion of the leg 48.

FIG. 7 shows the mounting spring in its normal unbiased or relaxed condition in which the tops of the legs 48, 50 forming the fastening portion of the U are bent backwards, and the legs 34, 36 of the exterior U then extend forward and cross the plane of the U formed by the fastening portion of the spring. Thus, the tops of the legs 34, 36 forming the exterior U are on one side of the fastening portion of the spring, and the bottom of the exterior U is on the opposite side of the fastening portion. The bottom 38 of the exterior U is spaced below the bottom 54 of the fastening portion. By bending the fastening portion of the spring toward the right in FIG. 7 relative to the exterior U, i.e., to a position in which the legs 48, 50 are more parallel to the legs 34, 36, the legs of the spring are held under stiff tension against the nomal bias of the spring which urges the legs of the spring toward the position in FIG. 7 in which the legs of the sprig intersect one another.

The mounting spring is securedto the inside face of the holster by inserting the fastenig portion of the spring through an upper opening 56 of a pcket formed on the inside face of the holster. The inside face of the holster is laminated, consisting of two identical overlapping leather pieces, and the space between the overlapping pieces forms the pocket to receive the fastening portion of the spring. A fastener 58 such as a rivet and a receptacle 59 for the rivet extend through the inside and outside leather pieces and through the opening in the curved portion 52 of the mounting spring inside the pocket. The rivet is hammered into the receptacle to form a fixed post that restrains movement of the spring. Parallel upper and lower rows of stitching 60, 62 are provided to close the opening 56 after the mounting spring is inserted. A slit 64 allows the right leg of the U to be moved over for clearance in providing stitching 66 along the right side of the holster. Similarly, a slit 68 is provided near the upper left hand-portion of the pocket to provide clearance for moving the left leg of the mounting clip out of the way when stitching 70 is provided along the left side of the pocket.

Figure 4:
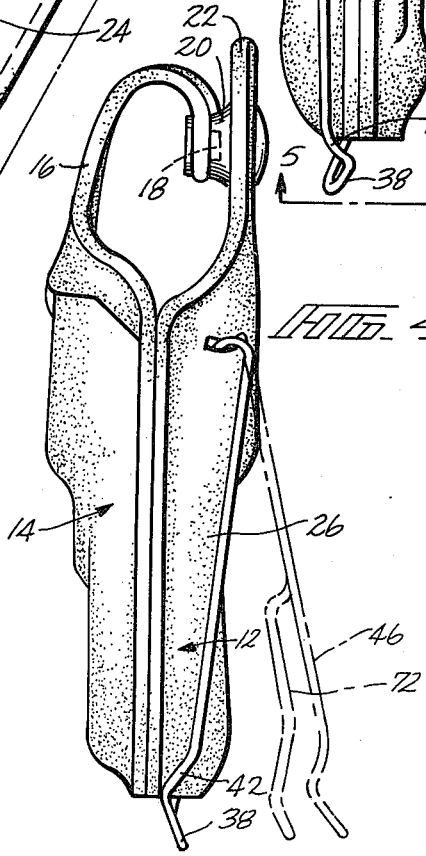
FIG. 4 is an end elevation view taken on line 4—4 of FIG. 1.
Figure 5:
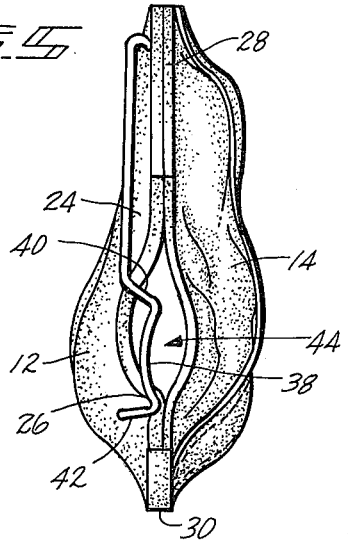
FIG. 5 is a bottom view taken on line 5—5 of FIG. 2.

In use, the holster may be worn close to the hip of the user simply by pulling outwardly on the mounting spring against its normal bias as illustrated in FIG. 4 to provide a gap between the mounting spring and the inside face of the holster. The mounting spring is then slipped into the narrow space between the body of the user and the inner side of the waistband of the user's clothing, or the inner side of a belt worn by user. The mounting spring is then released and the tension of the spring against the clothing and the inside face of the holster (closely adjacent the outside contour of the firearm) provides means for tightly securing the holster in any desired position. As illustrated in FIG. 4, a bend can be added to the spring at 72 to make the spring better conform to a belt, if desired. The bend can be approximately $2\frac{1}{4}$ inches below the top of the spring so that it will accommodate belts up to about 2 inches in width.

Thus, the holster can be worn very close to the user's body without the necessity of using a belt to hold the holster or threading the belt through belt loops or the like. The holster may be quickly removed without the necessity of removing a belt which holds the holster. Since the bias of the mounting spring holds the holster tightly in its desired position, the user can wear the holster in practically any desired orientation he wishes, whether it be a conventional orientation, or a cross-draw orientation, or any other desired position.

As described above, the mounting spring can be used for mounting other similar items, such as knife sheaths which can be carried on other articles such as a boot or purse, for example. Although the invention has been described and claimed with respect to a holster and its uses, it should be understood that similar items and uses are within the scope of the following claims.

I claim:

1. A holster or the like having a carrying case with an inner face to be located adjacent to the body of a user wearing the case; a mounting spring secured to and overlying the exterior of the inner face of the case, the mounting spring being under tension applying a spring force against the inner face of the case, in which the mounting spring is a wire rod having exterior legs forming a generally U-shaped exterior mounting portion and interior legs forming an interior fastening portion of the spring, the spring bearing bent so the interior legs normally intersect the plane of the exterior legs when the spring is in its unbiased position; and means securing the fastening portion of the mounting spring to the inner face of the holster case so that the exterior legs are held away from said normal position and in stiff tension against the inner face of the case, the lower portion of the U formed by the exterior mounting spring being located generally near the bottom of the case, the exterior legs of the spring being movable against their bias away from the inner face of the case to form a narrow gap for receiving clothing or the like to which the case is releasably attached by the tension of the mounting spring.

2. Apparatus according to claim 1, in which the inner face of the case is contoured to project outwardly to accommodate the shape of a device carried in the case, the contour having a pair of spaced apart ridges extending adjacent opposite edges of the case; and in which the exterior legs of the mounting spring extend adjacent the ridges formed by the contour.

3. Apparatus according to claim 2, in which the exterior legs of the U-shaped mounting spring are urged against the inner face of the case adjacent the ridges formed by the contour.

4. Apparatus according to claim 1, in which the fastening portion of the mounting spring fits into a pocket formed on the inside face of the case; and including fastening means extending through the inside face of the case for holding the fastening portion of the mounting spring in the pocket.

5. Apparatus according to claim 4, in which the pocket includes an opening for receiving the fastening portion of the spring, and including stitching on opposite sides of the opening for closing the opening to the pocket when the mounting spring is in place in the pocket.

6. Apparatus according to claim 1, in which the lower U-shaped portion of the mounting spring protrudes below the bottom edge of the case.

7. Apparatus according to claim 4 in which the interior legs of the spring converge to form a U, and in which the fastener extends through a lower portion of the U formed by the interior legs of the spring.

8. Apparatus according to claim 7 in which at least one of the interior legs forms a hook near the bottom of the U, and the hook fits around the fastener.

9. A holster or the like having a carrying case with an inner face to be located adjacent to the body of a user wearing the case; a mounting spring secured to and overlying the exterior of the inner face of the case, the mounting spring being under tension applying a spring force against the inner face of the case, in which the mounting spring is a wire rod having exterior legs forming a generally U-shaped exterior mounting portion of the spring and interior legs forming an interior fastening portion of the spring, the spring being bent so the interior legs near the top of the spring normally extend away from one side of the plane of the exterior legs and the interior legs then extend back toward the plane of the exterior legs and extend downwardly and intersect the plane of the exterior legs when the spring is in its unbiased position; and means securing the fastening portion of the mounting spring to the inner face of the holster case so that the exterior legs are held away from said normal position and in stiff tension against the inner face of the case, the exterior legs of the spring being movable against their bias away from the inner face of the case to form a narrow gap for receiving clothing or the like to which the case is releasably attached by the tension of the mounting spring.

10. Apparatus according to claim 9 in which the inner face of the case is contoured to project outwardly to accommodate the shape of a device carried in the case, the contour having a pair of spaced apart ridges extending adjacent opposite edges of the case; and in which the exterior legs of the mounting spring extend adjacent the ridges formed by the contour.

11. A holster or the like having a carrying case with an inner face to be located adjacent to the body of user wearing the case; a mounting spring secured to and overlying the inner face of the case, the mounting spring being under tension applying a spring force against the inner face of the case, in which the mounting spring is a wire rod having exterior legs forming a generally U-shaped exterior mounting portion and interior legs forming an interior fastening portion of the spring, the exterior legs being in a first plane with the spring being bent so that interior legs are in a second plane at an angle to the first plane when the spring is in its unbiased position; and means securing the fastening portion of the mounting spring to the inner face of the holster case so the inner face of the case applies pressure to the exterior legs of the spring and holds the exterior legs in a position more parallel to the inner legs of the case so that the exterior legs apply stiff tension against the inner face of the case through the tendency of the exterior legs to move back toward the unbiased position of the spring, the exterior legs of the spring being movable against their bias away from the inner face of the case to form a narrow gap for receiving clothing or the like to which the case is releasably attached by the tension of the mounting spring.

12. Apparatus according to claim 11 in which the inner face of the case is contoured to project outwardly to accommodate the shape of a device carried in the case, the contour having a pair of spaced apart ridges extending adjacent opposite edges of the case; and in which the exterior legs of the mounting spring extend adjacent the ridges formed by the contour.

* * * * *